US011648486B2

(12) United States Patent
Choi

(10) Patent No.: US 11,648,486 B2
(45) Date of Patent: May 16, 2023

(54) TRANSFORMABLE TOY

(71) Applicant: CHOIROCK CONTENTS COMPANY CO., LTD., Seoul (KR)

(72) Inventor: Jong-Ill Choi, Seoul (KR)

(73) Assignee: Choirock Contents Company Co., Ltd.

( * ) Notice: Subject to any disclaimer, the term of this patent is extended or adjusted under 35 U.S.C. 154(b) by 0 days.

(21) Appl. No.: 17/404,822

(22) Filed: Aug. 17, 2021

(65) Prior Publication Data

US 2021/0370195 A1 Dec. 2, 2021

Related U.S. Application Data

(62) Division of application No. 16/389,247, filed on Apr. 19, 2019, now Pat. No. 11,123,653.

(30) Foreign Application Priority Data

Sep. 21, 2018 (KR) ..... 10-2018-0113859

(51) Int. Cl.
*A63H 33/26* (2006.01)
*A63H 33/00* (2006.01)
*A63H 17/00* (2006.01)

(52) U.S. Cl.
CPC ..... *A63H 33/26* (2013.01); *A63H 33/003* (2013.01); *A63H 17/008* (2013.01)

(58) Field of Classification Search
CPC ..... A63H 33/003; A63H 33/26; A63H 17/02; A63H 17/008
USPC ..... 446/72, 129, 130, 139, 309, 310, 311, 446/376, 441, 487
See application file for complete search history.

(56) References Cited

U.S. PATENT DOCUMENTS

| | | | | |
|---|---|---|---|---|
| 4,698,043 | A * | 10/1987 | May | A63H 33/005 446/273 |
| 7,785,168 | B2 * | 8/2010 | Yamada | A63H 3/003 446/99 |
| 8,500,508 | B2 * | 8/2013 | Yamada | A63H 11/00 446/139 |
| 9,308,461 | B2 * | 4/2016 | Yamada | A63H 11/00 |
| 9,370,725 | B2 * | 6/2016 | Choi | A63F 1/04 |
| 9,573,072 | B2 * | 2/2017 | Cai | A63H 17/264 |
| 9,744,435 | B2 * | 8/2017 | Choi | A63H 33/003 |
| 9,868,073 | B2 * | 1/2018 | Yamada | A63H 33/003 |
| 9,975,058 | B2 * | 5/2018 | Yamada | A63H 11/00 |
| 10,258,867 | B2 * | 4/2019 | Choi | A63F 1/06 |
| 10,307,684 | B2 * | 6/2019 | Choi | A63H 17/02 |
| 10,421,028 | B2 * | 9/2019 | Choi | A63H 17/264 |
| 10,434,400 | B2 * | 10/2019 | Choi | A63H 17/26 |
| 10,695,687 | B2 * | 6/2020 | Fernandez | A63H 33/003 |

(Continued)

*Primary Examiner* — Joseph B Baldori
(74) *Attorney, Agent, or Firm* — Lewis Roca Rothgerber Christie LLP

(57) ABSTRACT

A transformable toy including a main body and a transformation inducing unit, wherein the main boy includes a body part; at least one first body portion; at least one pressing part; and a locking part to fix the body part and the first body portion to the main body. When the locking part is unlocked by an operation of the transformation inducing unit, the first body portion and the one pressing part are moved away from the body part such that the toy transforms from a first shape into a second shape in which at least a portion of the main body is caused to be floating from a floor by the pressing part.

14 Claims, 12 Drawing Sheets

(56) References Cited

U.S. PATENT DOCUMENTS

| | | | | |
|---|---|---|---|---|
| 10,814,240 | B2 * | 10/2020 | Cai | A63H 33/003 |
| 10,864,452 | B2 * | 12/2020 | Fernandez | A63H 13/00 |
| 10,987,604 | B2 * | 4/2021 | Yamada | A63H 33/003 |
| 11,123,653 | B2 * | 9/2021 | Choi | A63H 33/26 |
| 2007/0197124 | A1 * | 8/2007 | Sato | A63H 11/00 446/129 |
| 2010/0291831 | A1 * | 11/2010 | Yamada | A63H 33/003 446/129 |
| 2017/0106307 | A1 * | 4/2017 | Yamada | A63H 17/008 |
| 2018/0133612 | A1 * | 5/2018 | Choi | A63H 9/00 |
| 2018/0147502 | A1 * | 5/2018 | Choi | A63H 33/003 |
| 2018/0169537 | A1 * | 6/2018 | Choi | A63H 33/26 |

* cited by examiner

【FIG. 1】
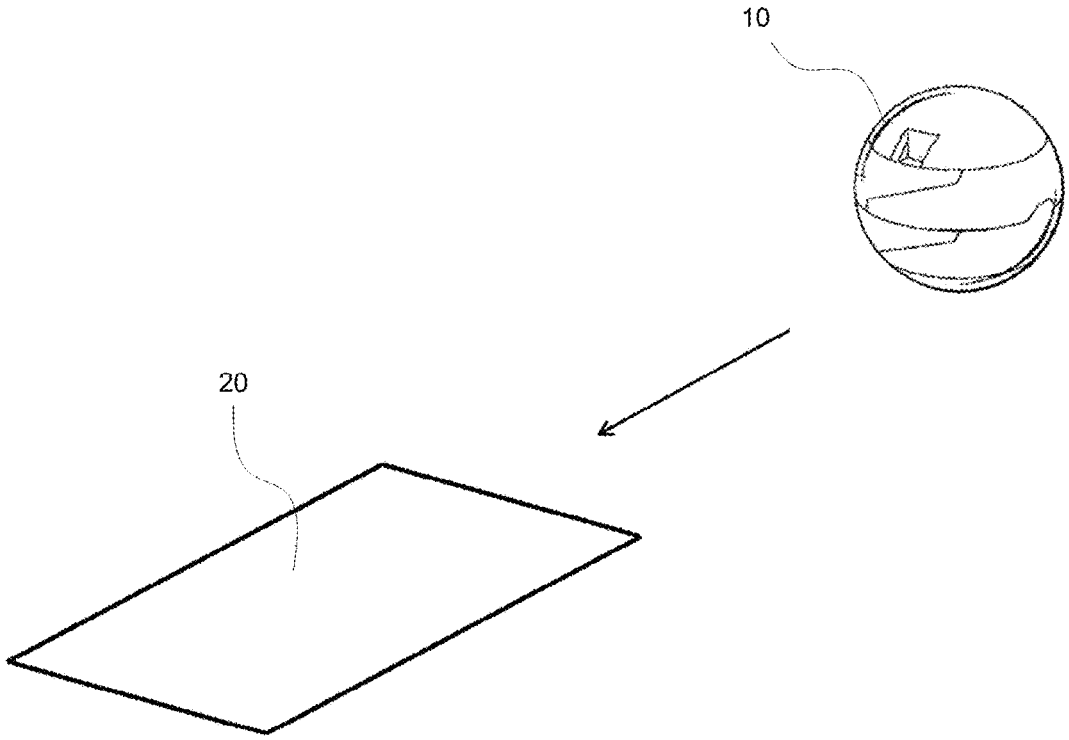

【FIG. 2】
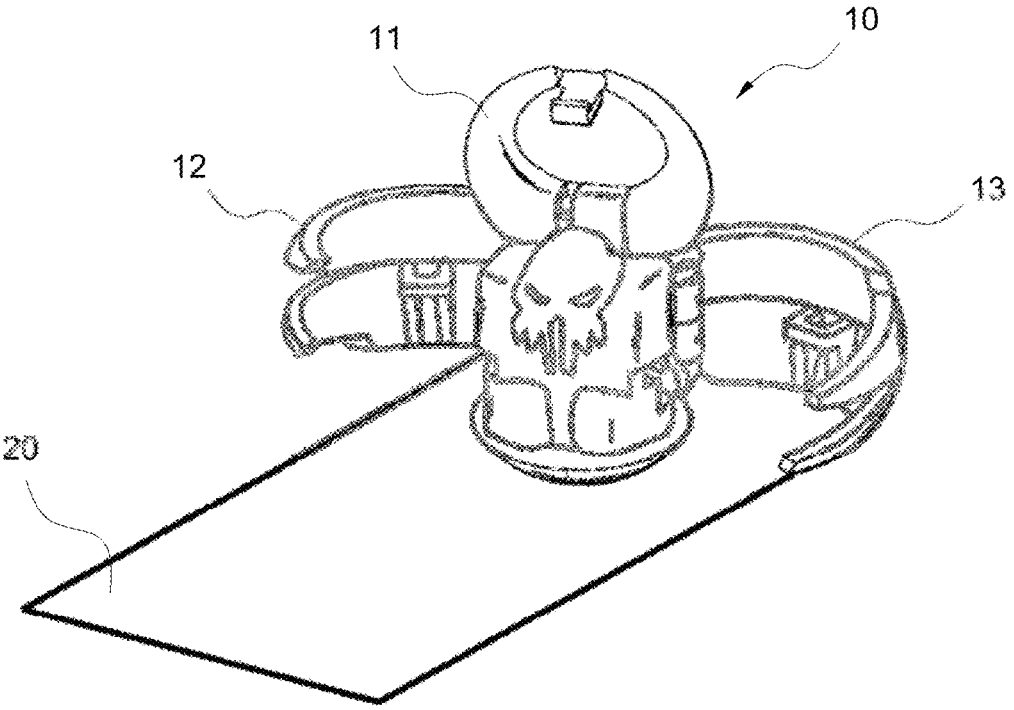

【FIG. 3】
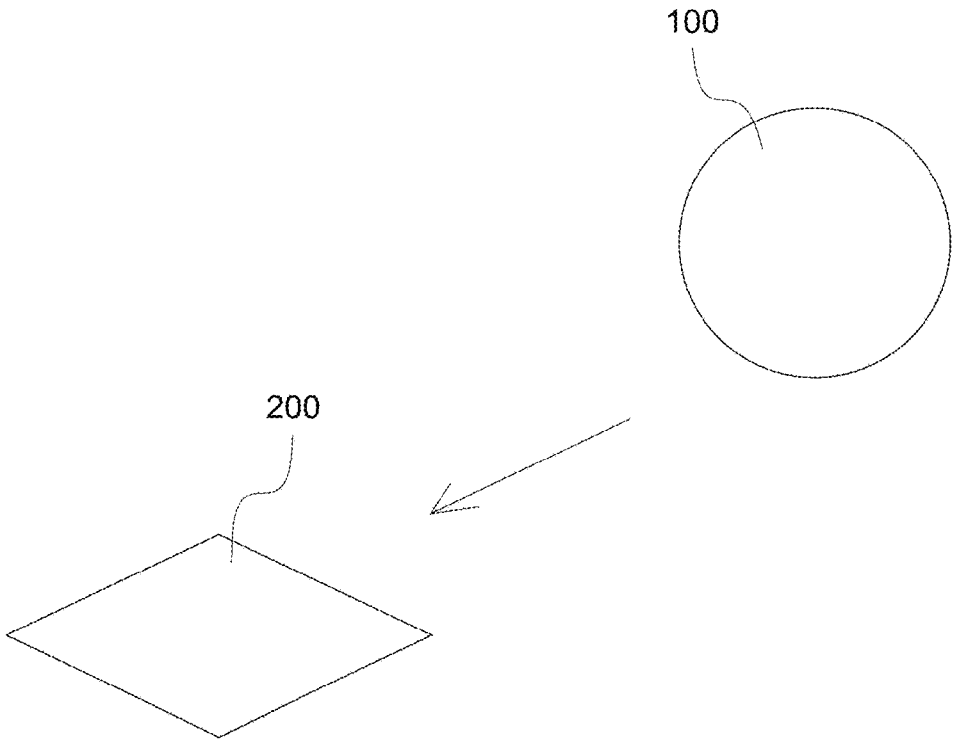

【FIG. 4】
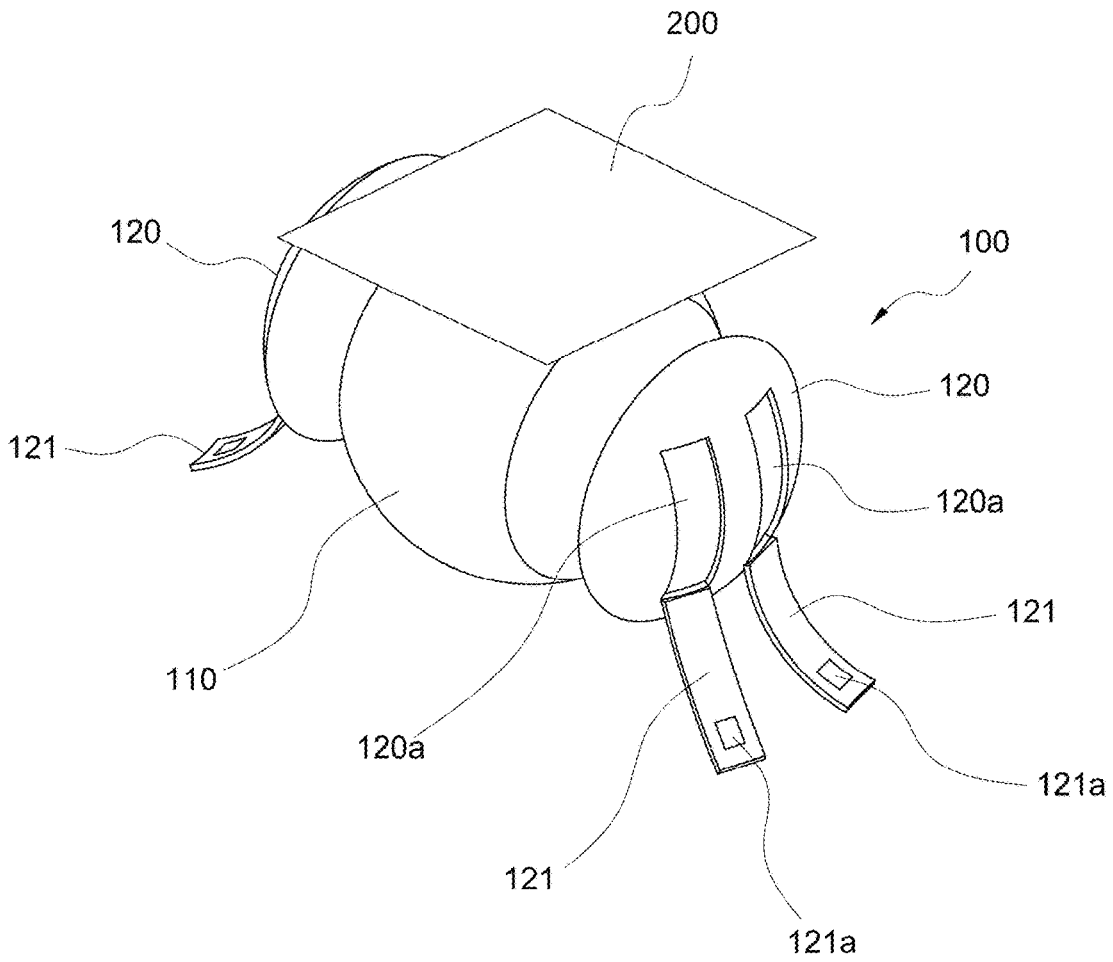

【FIG. 5】
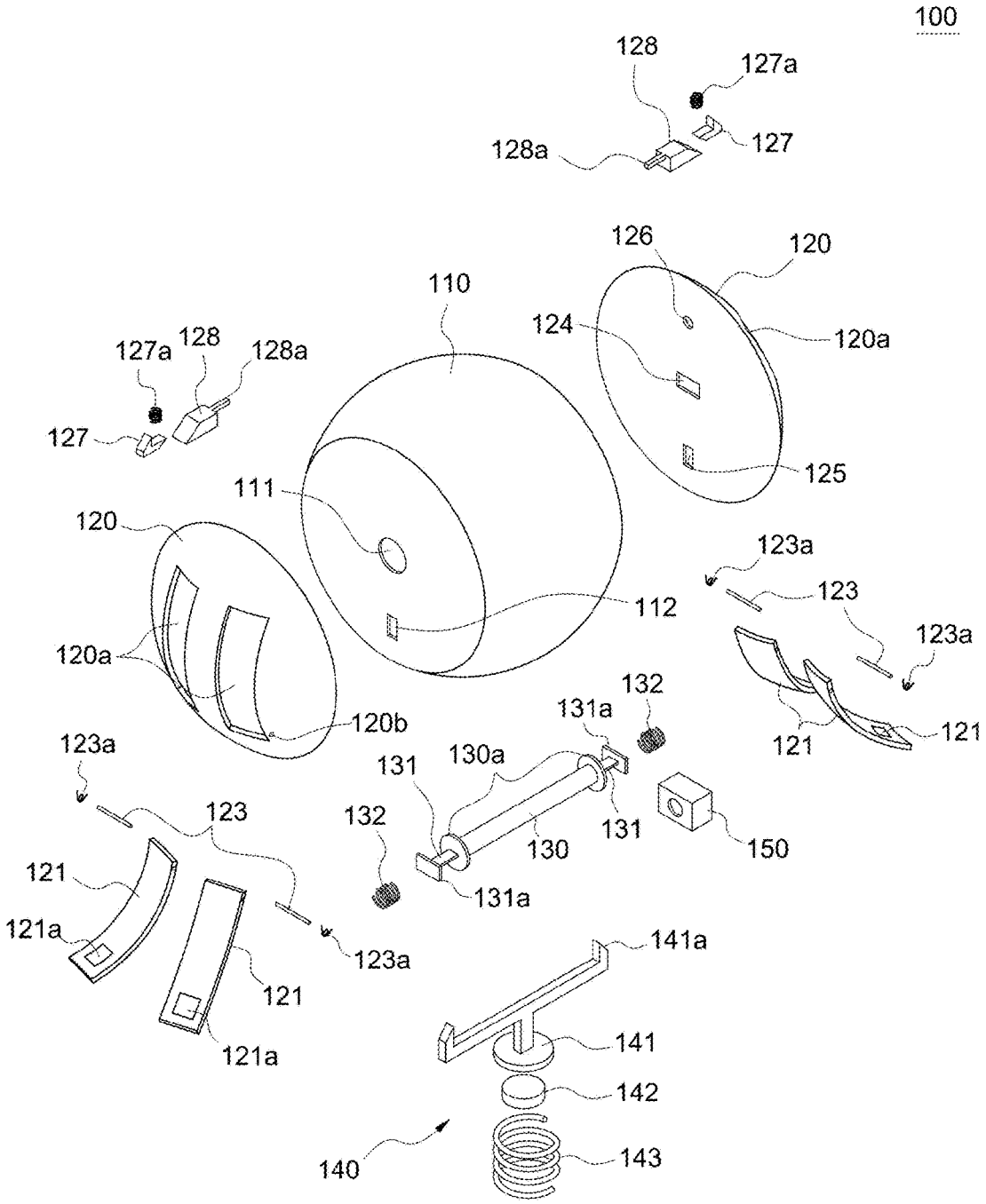

【FIG. 6】
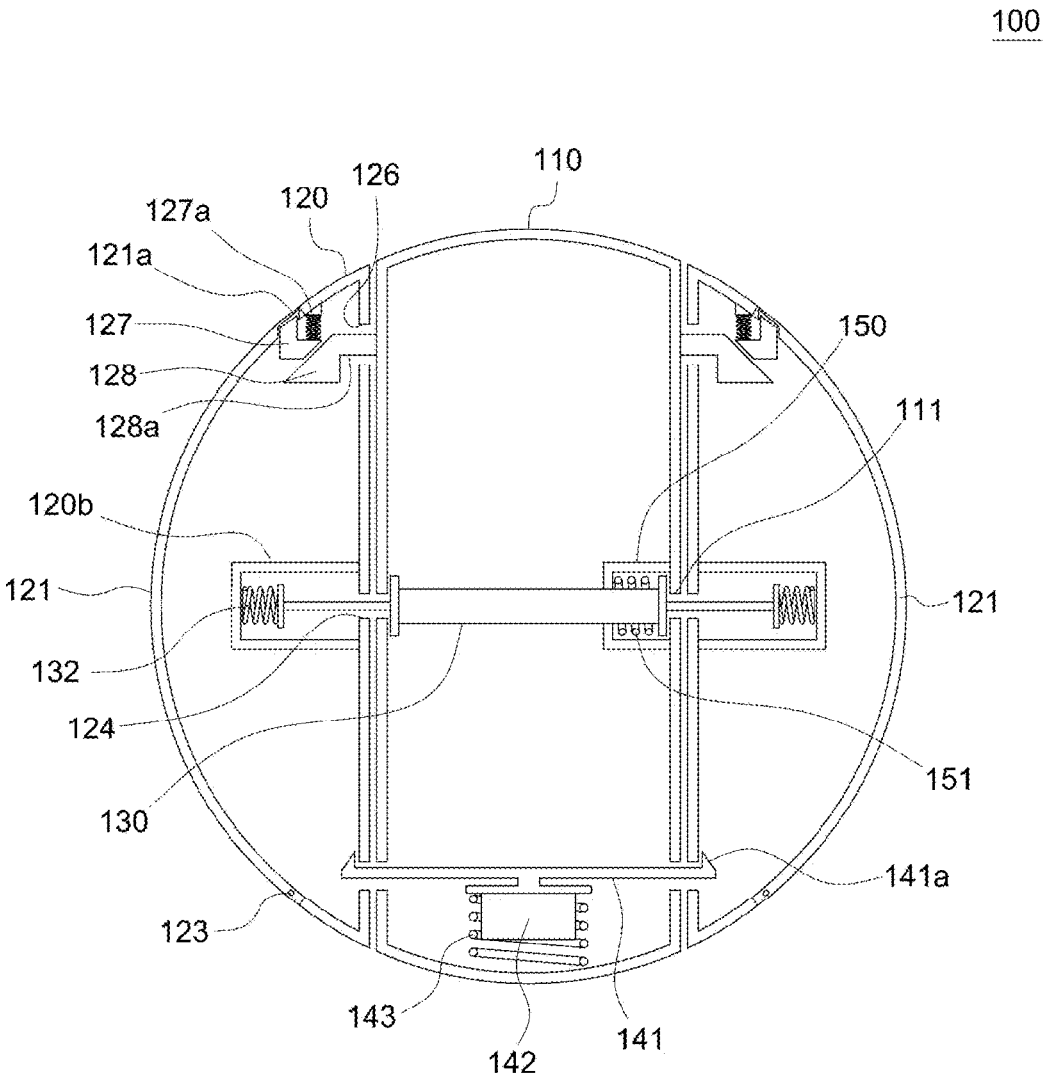

【FIG. 7】
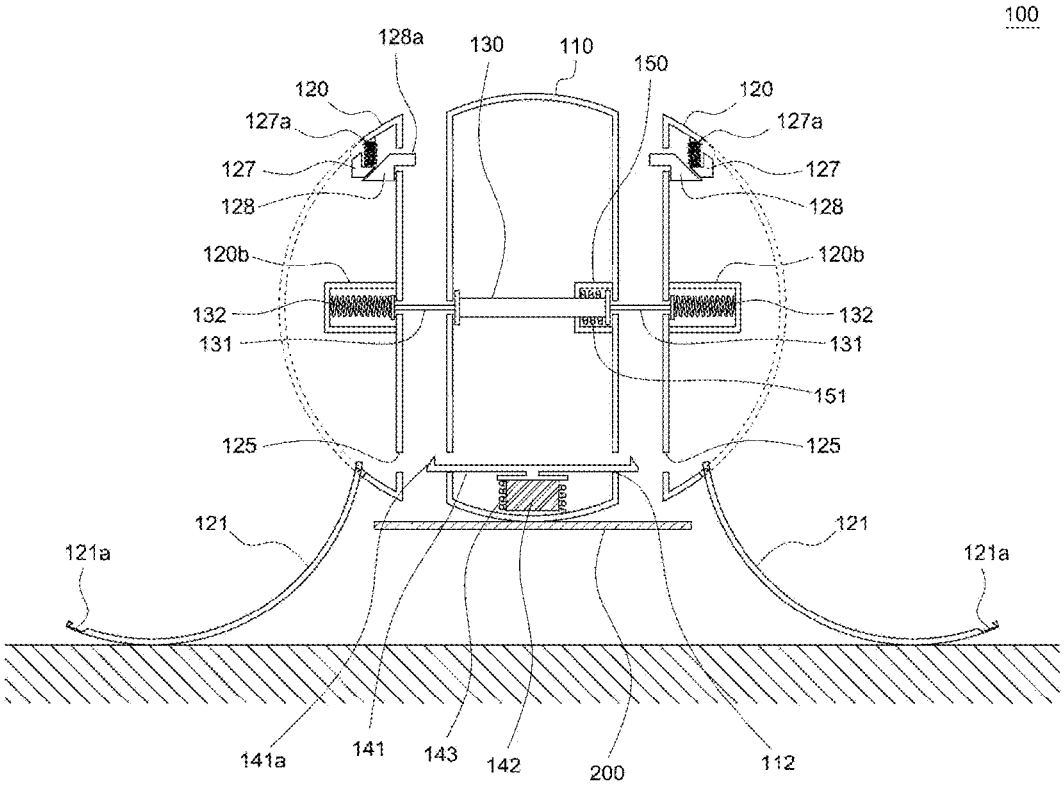

【FIG. 8】
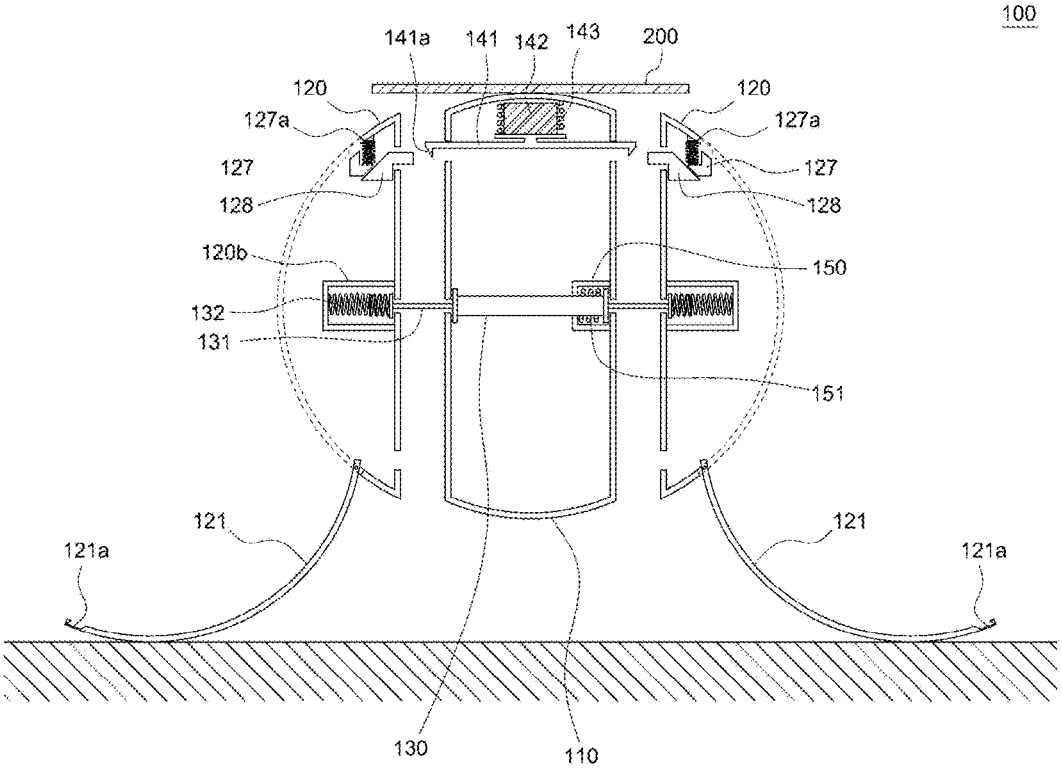

【FIG. 9】
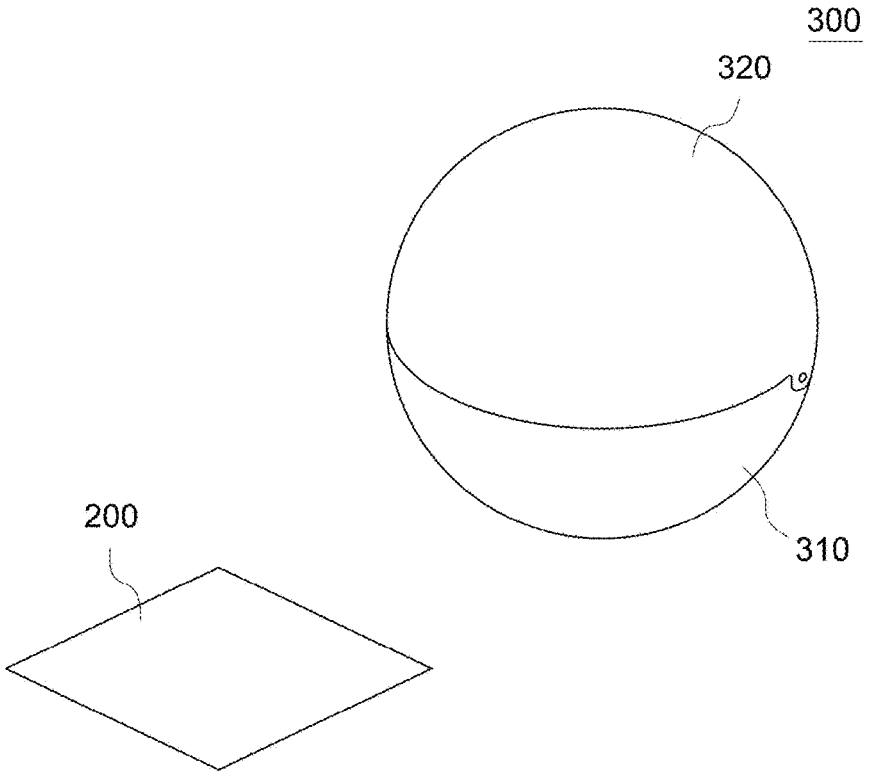

【FIG. 10】
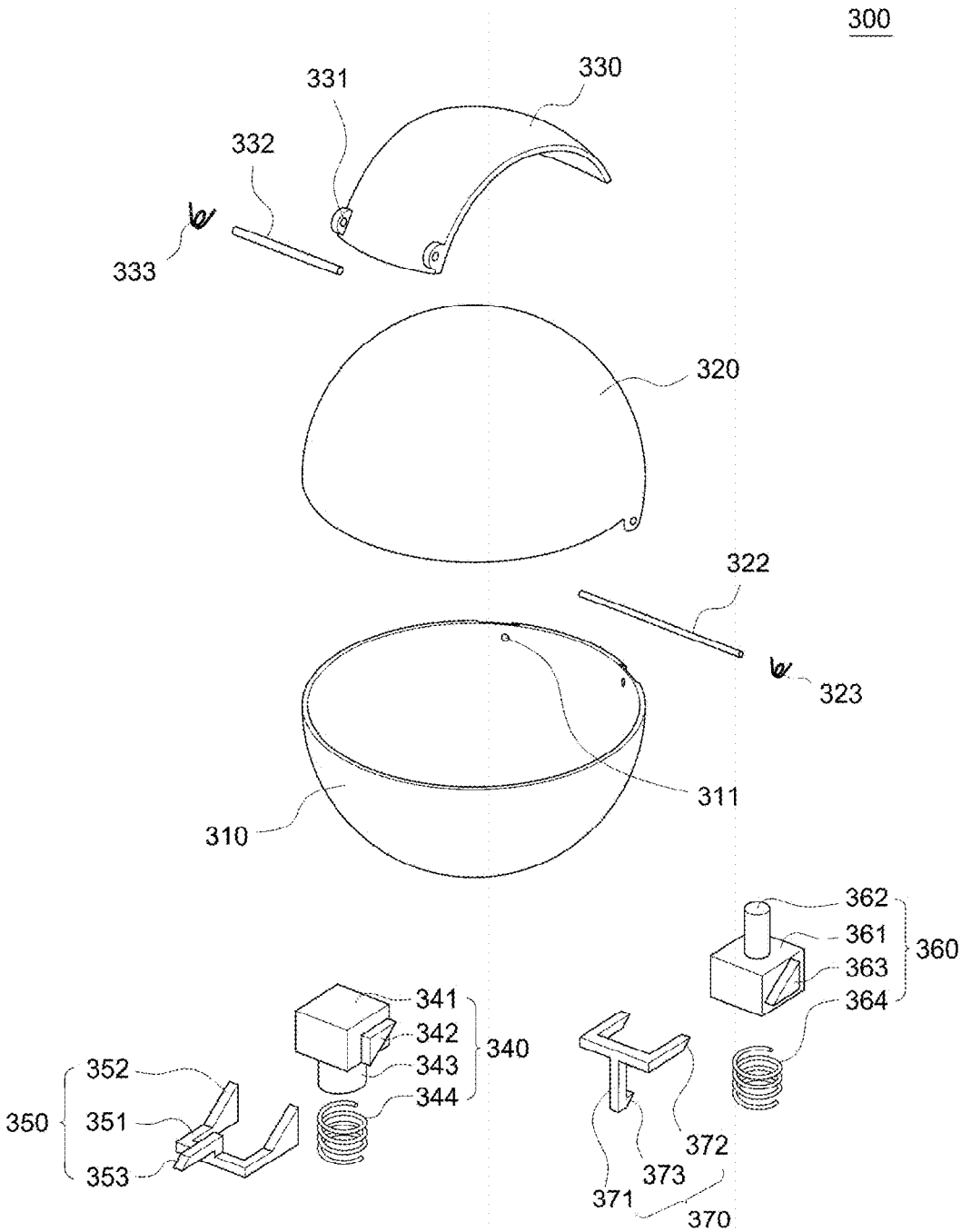

【FIG. 11】
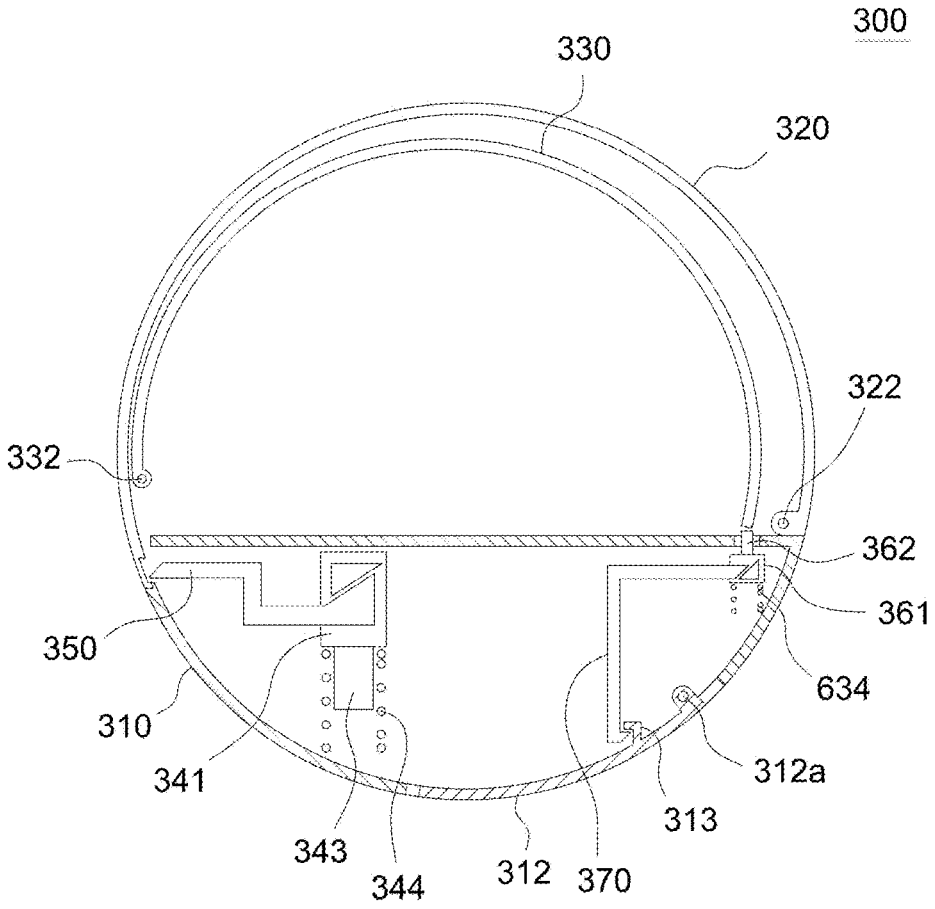

【FIG. 12A】
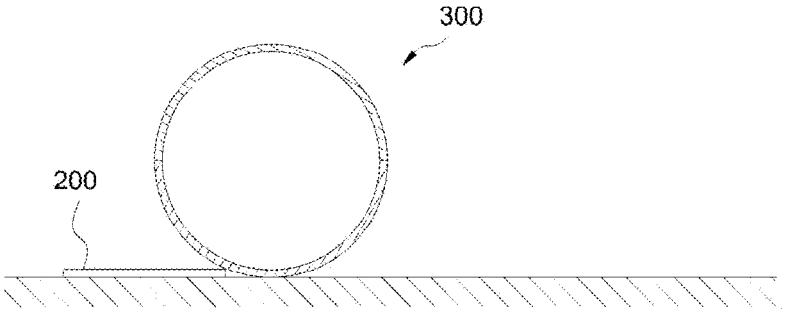
【FIG. 12B】
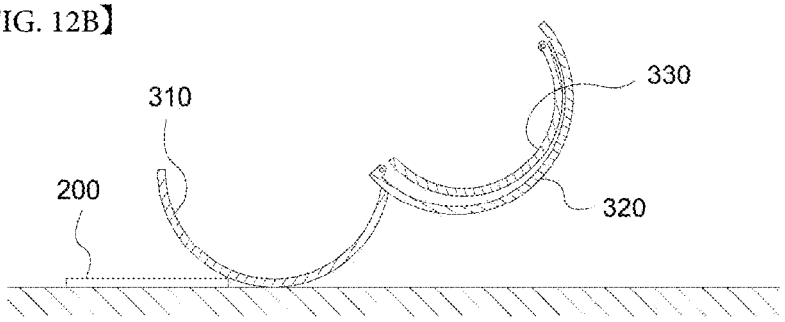
【FIG. 12C】
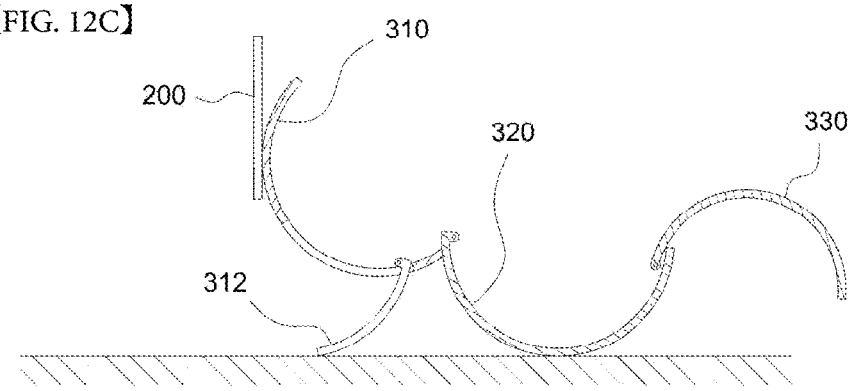

TRANSFORMABLE TOY

CROSS REFERENCE TO RELATED APPLICATION

The present application is a divisional of U.S. patent application Ser. No. 16/389,247 filed on Apr. 19, 2019, which claims priority to Korean Patent Application No. 10-2018-0113859 filed on Sep. 21, 2018, in the Korean Intellectual Property Office, the entire disclosures of which are incorporated herein by reference for all purposes.

BACKGROUND OF THE INVENTION

1. Field of the Invention

The present disclosure relates to a transformable toy, and more particularly, to a transformable toy, in which, when an arbitrary transformation inducing unit comes into contact with a body of the toy, the transformation inducing unit and the body are transformed together.

2. Description of the Prior Art

A transformable toy has various toy bodies formed in a robot shape or an automobile shape, in which the toy bodies are assembled such that the transformable toy is transformed into a robot or an automobile toy. Such a transformable toy has an advantage in that since a variety of shapes are represented within a single toy, children may enjoy playing with the toy in a variety of ways through transformation while directly assembling the toy.

In recent years, toys that provide various effects using the action of a magnetic force have been proposed.

Korean Patent Laid-Open Publication No. 10-2008-0101924 (entitled "Toy") discloses a toy including an outer structure and an inner structure accommodated inside the outer structure. The outer structure includes an outer locking part, and a spring that transforms the outer structure from a first shape into a second shape, which can be electrically driven, and the internal structure includes a magnet, an inner locking part that moves with the magnet, and a spring that biases the inner locking part in a specific direction. When no magnetic force acts, the locking state of the inner locking part and the outer locking part is implemented so that the first shape of the outer structure is maintained. When the magnetic force is applied, the magnet and the inner locking part move so that the locking state of the inner locking part and the outer locking part is released and thus the outer structure is transformed into the second shape.

FIG. 1 is a perspective view illustrating an operation state of a toy according to the related art, and FIG. 2 is a perspective view illustrating another operation state of the toy according to the related art.

As illustrated in FIGS. 1 and 2, in a toy 10 according to the related art, when a magnetic body is brought into contact with a card 20 installed in the inside of a ball-shaped body while the body is moving along the ground, the locking state is released by the magnet contained in the toy 10, so that a plurality of members 11, 12, and 13 rotate to transform the outer shape from a first shape to a second shape, and the transformed toy is fixed on a card 20.

However, the prior art toy only provides a transformation operation of the toy, and has a problem in that it cannot provide an operation of transforming the card and the toy together.

In addition, the prior art toy has a problem in that it cannot perform various game methods using information hidden on the bottom surface of the card.

In addition, the prior art toy has a problem in that, when the toy comes into contact with the card while moving, the transformed toy stops on the card, so that the transformed toy cannot move any more nor perform an operation.

PRIOR ART DOCUMENT

Patent Document

Korean Patent Laid-Open Publication No. 10-2008-0101924 (entitled "Toy")

SUMMARY OF THE INVENTION

The present disclosure has been made in order to solve the problems described above, and provides a transformable toy, in which, when an arbitrary transformation inducing unit comes into contact with a body of the toy, the transformation inducing unit and the body are transformed together.

According to one or more embodiments of the present disclosure, a transformable toy having a first shape before transformation includes: a main body; and a transformation inducing unit, wherein the main body comprises: a body part; at least one first body portion displaceably connected to the body part, at least one pressing part being rotatably connected to the at least one first body portion; and a locking part configured to fix the body part and the at least one first body portion to the main body. When the locking part is unlocked by an operation of the transformation inducing unit, the first body portion is moved away from the part, and the at least one pressing part connected to the at least one first body portion is moved away from the body part, so that the toy transforms into a second shape in which at least a portion of the main body is caused to be floating from a floor by the pressing part.

In an embodiment, the first shape is any one of a spherical shape, a cylindrical shape, and an elliptical shape.

In an embodiment, an operation through which the first body portion and the body portion are moved away from the body part includes a rotating operation.

In an embodiment, in the second shape, the entire main body except for the pressing part is transformed into a state of floating from the floor.

In an embodiment, the transformation of the toy by the transformation inducing unit includes an operation in which at least a portion of the main body lifts up the transformation inducing unit.

In an embodiment, in the second shape, a bottom surface of the transformation inducing unit is exposed when the transformation inducing unit is lifted up by the portion of the main body.

In an embodiment, the portion that lifts up the transformation inducing unit is the body part of the main body.

In an embodiment, the unlocking of the locking part by the transformation inducing unit is caused by a magnetic force.

In an embodiment, in the second shape, at least one of the body part and the first body portion of the main body is transformed into a state of floating from the floor.

In an embodiment, the main body performs an operation of jumping before the at least one of the body part and the first body portion of the main body is transformed into the state of floating from the floor.

In an embodiment, the second shape of the transformable toy forms a shape of any one of an object, an animal, a human, and a character.

In an embodiment, the transformable toy further includes: a rotary shaft installed on the body part and coupled to the first body portion at each end thereof, the rotary shaft being configured to movably support the first body portion; and a rotary shaft torsion part installed on the body part and the rotary shaft, the rotary shaft torsion part being configured to provide an elastic force such that the body part rotates about the rotary shaft when the first body portion is moved away from the body part.

In an embodiment, the body part includes an accommodation space formed therein and the locking part is installed on the body part to support the first body portion such that the first body portion is fixed to the body part, wherein the locking part is configured to unlock first body portion when the locking part is attached to the transformation inducing unit.

In an embodiment, the locking part includes: a locking body part; a locking protrusion extending from an end of the locking body part by a predetermined length such that the first body portion is coupled thereto; a magnet installed on the bottom of the locking body part; and a locking spring configured to provide an elastic force such that the locking body part maintains a fixed position.

In an embodiment, the first shape forms a shape of a moving object.

In an embodiment, the first shape forms a shape of any one of an automobile, a ship, an airplane, a building, an object, an animal, and a character.

The present disclosure is advantageous in that the fun of playing with the toy can be further improved through a pop-up operation in which the body of the toy is developed.

In addition, the present disclosure is advantageous in that the toy can be played with in various ways such as playing cards can be performed by developing the spherical toy and lifting the transformation inducing unit disposed below the toy upwards.

BRIEF DESCRIPTION OF THE DRAWINGS

The above and other aspects, features and advantages of the present disclosure will be more apparent from the following detailed description taken in conjunction with the accompanying drawings, in which:

FIG. 1 is a perspective view illustrating an operation state of a toy according to the prior art;

FIG. 2 is a perspective view illustrating another operation state of the toy according to the prior art;

FIG. 3 is a perspective view illustrating a transformable toy according to the present disclosure;

FIG. 4 is a perspective view illustrating an operation state of the transformable toy according to the present disclosure;

FIG. 5 is an exploded perspective view illustrating the configuration of the transformable toy according to the present disclosure;

FIG. 6 is a cross-sectional view illustrating the configuration of the transformable toy according to the present disclosure;

FIG. 7 is a cross-sectional view illustrating an operation process of the transformable toy according to the present disclosure;

FIG. 8 is a cross-sectional view illustrating another operation process of the transformable toy according to the present disclosure;

FIG. 9 is a perspective view illustrating another embodiment of the transformable toy according to the present disclosure;

FIG. 10 is an exploded perspective view illustrating the configuration of the transformable toy according to FIG. 9;

FIG. 11 is a cross-sectional view illustrating the configuration of the transformable toy according to FIG. 9; and FIGS. 12A, 12B, and 12C are exemplary views illustrating an operation process of the transformable toy according to FIG. 9.

DETAILED DESCRIPTION OF THE EXEMPLARY EMBODIMENTS

Hereinafter, embodiments of a transformable toy according to the present disclosure will be described in detail with reference to the accompanying drawings.

Throughout the specification, when an element is described as "including" a certain constituent element, it means that other elements may be further included rather than being excluded.

In addition, the terms " . . . part", " . . . device", or " . . . module" mean a unit for processing at least one function or operation, and may be classified into hardware, software, or a combination thereof.

First Embodiment

FIG. 3 is a perspective view illustrating a transformable toy according to the present disclosure, FIG. 4 is a perspective view illustrating an operation state of the transformable toy according to the present disclosure, FIG. 5 is an exploded perspective configuration of the transformable view illustrating the toy according to the present disclosure, FIG. 6 is a cross-sectional view illustrating the configuration of the transformable toy according to the present disclosure, FIG. 7 is a cross-sectional view illustrating an operation process of the transformable toy according to the present disclosure, and FIG. 8 is a cross-sectional view illustrating another operation process of the transformable toy according to the present disclosure.

As illustrated in FIGS. 3 to 8, a transformable toy 100 according to the first embodiment of the present disclosure includes a body part 110, first body portions 120, a rotary shaft 130, a locking part 140, a rotary shat torsion part 150, and a transformation inducing unit 200. When the first body portions 120 displaceably installed on the body part 110 are fixed to the body part 110 by the locking part 140 and the locking part 140 is bonded to the transformation inducing unit 200 to be unlocked, the first body portions 120 are separated from the body part 110. When the first body portions 120 are separated, pressing parts 121 displaceably installed on the first body portions 120 are developed to cause the body part 110 and the first body portions 120 to pop up, and the body part 110 is displaced with the transmission inducing unit 200.

The transformable toy may have a first shape, which is formed in any one of a spherical shape, a cylindrical shape, an ellipsoidal shape, and any shape including a wheel, and is preferably formed in a spherical shape.

The present embodiment will be described with reference to the spherical shape as an example, but may be applied to any toys as long as the toys have shapes of transport means such as a car, a ship, and an airplane that roll in a certain direction along a floor or a ground, or any other shapes such as a building, an object, an animal, and a character that are provided with a wheel to be movable.

In addition, the transformable toy may have a second shape, which may be formed in any one of an object shape, an animal shape, a human shape, and a character shape, and the character shape may be a specific character representing a character, an object, etc. appearing in animation.

The body part 110 is a member having an accommodation space formed therein, first bodies 120 are disposed on the opposite sides of the body part 110, and the rotary shaft 130, the locking part 140, and the rotary shaft torsion portion 150 are provided inside the body part 110.

In addition, first through holes 111 are provided in the centers of the opposite sides of the body part 110 such that the rotary shaft 130 partially passes through the first through holes 111 to be exposed to the outside of the body part 110.

In addition, second through holes 112 are provided in the lower portions of the opposite sides of the body part 110 such that the locking part 140 partially passes through the second through holes 112 to be exposed to the outside of the body part 110.

The first body portions 120 are disposed on the opposite sides of the body part 110 and are fixed to or separated from the opposite sides of the body part 110 through the locking parts 140.

That is, when the locking parts 140 are in the locking position, the first body portions 120 are fixed to the opposite sides of the body part 110, so that the overall shape of the transformable toy 100 is maintained in a spherical shape, and when the locking parts 140 are in the unlocking position, the first body portions are spaced apart from the body part 110 by a predetermined distance.

In addition, each first body portion 120 includes a pressing part 121, a guide groove 124, a third through hole 125, a fourth through hole 126, a pressing part catch protrusion 127, and a latch part 128 such that the first body portion 120 is unlocked and displayed when separated from the body part 110.

The pressing parts 121 are disposed in the accommodation grooves 120*a* formed in the first body portions 120 and are rotatably installed on the first body portions 120 using the shafts 123, and each of the pressing parts 121 includes a spring 123*a* for providing an elastic force so that the pressing part 121 can be rotated.

In addition, the pressing parts 121 are able to perform an operation of pressing the body part 110 and the first body portions 120 to pop up in the upward direction from the ground using the elastic force of the springs 123*a*, the intensity of the elastic force for the pop-up operation is adjusted as necessary. When the spring force of the springs 123*a* is increased by a predetermined amount or more, the pressing parts 121 push the body part 110 and the first body portions 120 in the pop-up operation such that the body part 110 and the first body portions 120 jump up in the upward direction by a predetermined height.

In addition, each of the pressing parts 121 has a locking groove 121*a* formed in the inner surface thereof to be engaged with a pressing part locking protrusion 127. When the pressing part locking protrusion 127 is in the locking position, the pressing part locking protrusion 127 allows the pressing part 121 to maintain the state of being fixed to the first body portion 120. When the pressing part locking protrusion 127 is in the unlocking position, the pressing part locking protrusion 127 allows the pressing part 121 to be separated from the first body portion 120.

Each guide groove 124 is a member which is opened on one side and is provided in the inner surface of one of the first body portions 120 so that a guide part 131 of the rotation shaft 130 is inserted into the open side of the first body portion 120, and guides the movement of the rotary shaft 130 such that the rotary shaft 130 is movable inside the guide groove 124.

Each third through hole 125 may be engaged with one of the locking parts 140 protruding from the body part 110 so as to support the first body portion 120 such that the first body portion 120 is able to maintain the locking state in which the first body portion 120 is fixed to the body part 110, or may be separated from the locking part 140 such that the first body portion 120 is in the unlocked state to be separated from the body part 110.

Each fourth through hole 126 is perforated such that the latch part 128 provided on the first body portion 120 partially protrudes to the outside of the first body portion 120. When the first body 120 is separated and spaced apart from the body part 110, the fourth through hole 126 provides a path through which the latch part 128 is drawn out from the first body portion 120.

The pressing part locking protrusion 127 is engaged with the locking groove 121*a* formed in the pressing part 121 so that the pressing part 121 is fixed to the first body portion 120 such that the locking state is maintained, and the pressing part locking protrusion 127 has an inclined surface on one surface and is configured to move to the locking position or unlocking position depending on the position of the latch part 128.

In addition, the pressing part locking protrusion 127 is held at a predetermined position by the elastic force of the spring 127*a*.

The latch part 128 has an inclined surface provided on one side thereof to be slidably engaged with the pressing part locking protrusion 127 and a protrusion 128*a* provided at the other side thereof.

The protrusion 128*a* of the latch part 128 is in close contact with the side surface of the body part 110, so that, when the latch part 128 is moved to the inside of the first body portion 120, the protrusion 128*a* maintains the locking position in which the pressing part locking protrusion 127 is engaged with the locking groove 121*a*.

In addition, when the protrusion 128*a* is spaced apart from the side surface of the body part 110, the pressing part locking protrusion 127 moves the latch part 128 by the elastic force of the spring 127*a* and at the same time, moves to the unlocking position.

The rotary shaft 130 is installed in the body part 110, and the opposite ends thereof are engaged with the first body portions 120 to support the first body portions 120 to be slidable, and includes guide parts 131 and springs 132.

In addition, the rotary shaft 130 is a cylindrical member and is configured such that the body part 110 rotates around the rotary shaft 130, and is provided with radial flanges 130*a* such that the body part 110 does not move in the longitudinal direction of the rotary shaft 130.

The guide parts 131 are flat plate-shaped members extending from the opposite ends of the rotary shaft 130 by a predetermined length and are configured to prevent the first body portions 120 provided on the opposite sides of the body part 110 from rotating about the rotary shaft 130. The guide parts 131 are respectively inserted into the first body portions 120 so as to provide paths through which the guide parts 131 are tightly coupled to the opposite sides of the body part 110 or to be separated and spaced about the body part 110.

The springs 132 are installed in the guide grooves 124 of the first body portions 120 so as to provide an elastic force for pressing the guide parts 131, so that the first body portions 120 can be separated from the body part 110.

The locking part 140 is installed in the body part 110 to support the first body portions 120 to be fixed to the body part 110, and when the locking part 140 is bonded to the transformation inducing unit 200 and is displaced, the first body portions 120 are unlocked. The locking part 140 includes a locking body part 141, locking protrusions 141*a*, a magnet 142, and a locking part spring 143.

The locking body part 141 is provided with the locking protrusions 141*a* at the opposite ends thereof to extend by a predetermined length such that the first body portions 120 are coupled to the locking protrusions 141*a*, respectively.

The magnet 142 is installed in the lower portion of the locking body 141, and when the transformation inducing unit 200 is positioned below the body part 110 or around the magnet unit 142, the magnet 142 generates a magnetic field and comes into contact with the transformation inducing unit 200 through the attractive force, so that the locking body 141 is moved from the locking position to the unlocking position.

The locking part spring 143 is configured to provide an elastic force such that the locking body part 141 maintains a predetermined position. When the locking body part 141 moves to the unlocking position due to the magnet 142 and an attractive force generated by the electric field disappears, the locking body part 141 and the magnet 142 are returned to the locking position.

The rotary shaft torsion part 150 is installed in the body part 110 and on the rotary shaft 130. When the first body portions 120 are separated from the body part 110, the rotary shaft torsion part 150 is configured to provide an elastic force such that the body part 110 rotates about the rotary shaft 130. The rotary shaft torsion part includes a torsion spring 151 installed therein.

That is, the rotary shaft torsion part 150 is coupled to the body part 110, one side of the torsion spring 151 is connected to the rotary shaft torsion part 150, and the other side of the torsion spring 151 is connected to the rotary shaft 130. Thus, when the body part 110 rotates above the rotary shaft 130, an elastic force is generated in the torsion spring 151, so that when the body part 110 is separated from the first body portions 120, the elastic force is provided to rotate the body part 110 about the rotary shaft 130.

At this time, the body part 110 and the transformation inducing unit 200 bonded to the body part 110 are rotationally displaced together about the first body portions 120.

The transformation inducing unit 200 includes at least one of a magnet and a magnetic body therein and is configured to generate a magnetic attractive force with the magnet 142 of the locking part 140. The outer shape of the transformation inducing unit 200 is formed by a member formed in any one of a polygonal plate shape, a hexahedron shape, a disk shape, a ring shape, an arbitrary character shape, a transportation means shape, a building shape, and an arbitrary object shape provided with wheels.

In addition, the transformation inducing unit 200 may be configured to be coupled with the transformable toy 100 to have an arbitrary shape, or may be configured as a separable toy like the transformable toy 100.

That is, the transformation inducing unit 200 and the transformable toy 100 may be combined to form a combined toy having a new overall shape.

Hereinafter, an operation process of the transformable toy 100 according to the present disclosure will be described.

As illustrated in FIG. 6, the first body portions 120 are tightly coupled to the body part 110 interposed therebetween to be rotatable about the rotary shaft 130.

At this time, the locking protrusions 141*a* of the locking part 140 are engaged with the first body portions 120 disposed on the opposite sides such that the first body portions 120 are maintained at the locked state.

In addition, the guide parts 131 of the rotary shaft 130 are inserted into the guide grooves 124 in the first body portions 120 and press the springs 132 to be in a compressed state.

In addition, the body part 110 presses the protrusions 128*a* of the latch part 128 such that the pressing part locking protrusions 127 are fixedly engaged with the pressing parts 121 at the locked position.

Then, the transformable toy 100 is rolled or moved to the transformation inducing unit 200 disposed at an arbitrary position so that the transformable toy 100 and the transformation inducing unit 200 are brought into contact with each other as illustrated in FIG. 7, and when an attractive force is generated between the locking part 140 and the transformation inducing unit 200 due to the magnetic field and the locking part 140 moves towards the transformation inducing unit 200, the body part 110 and the first body portions 120 are unlocked.

When the first body portions 120 are unlocked from the body part 110, the springs 132 of the rotary shaft 130 provides an elastic force to urge the first body portions 120 to be separated from the body part 110 to the opposite sides. When the first body portions 120 are separated from the body part 110, the pressing force applied by the latch parts 128 disappears and the springs 127*a* provided on the pressing part locking protrusions 127 cause the locked state of the pressing part locking protrusions 127 to be released.

When the locked state of the pressing part locking protrusions 127 are released, the pressing parts 121 are rotated by the elastic force of the springs 123*a* to press against the ground, and the pressing part locking protrusions 127 cause the body part 110 and the first body portions 120 to be popped up in the upward direction.

When the body part 110 and the first body portions 120 are popped upwards, the pressing parts 121 are held to be in close contact with the ground, and the rotary shaft torsion part 150 causes the body part 110 to be rotated together with the transformation inducing unit 200 as illustrated in FIG. 8 by the elastic force of the torsion spring 151.

Second Embodiment

First, redundant descriptions of the same components as those of the first embodiment are omitted, and the same reference numerals are used for the same components.

FIG. 9 is a perspective view illustrating another embodiment of the transformable toy according to the present disclosure, FIG. 10 is an exploded perspective view illustrating the configuration of the transformable toy according to FIG. 9, FIG. 11 is a cross-sectional view illustrating the configuration of the transformable toy according to FIG. 9, and FIG. 12 is an exemplary view illustrating an operation process of the transformable toy according to FIG. 9.

As illustrated in FIGS. 9 to 12, a transformable toy 300 according to a second embodiment includes a body part 310, a first body portion 320, a second body portion 330, a latch part 340, a locking part 350, an auxiliary latch part 360, and an auxiliary locking part 370. When the first body portion 320 displaceably installed on the body part 310 is fixed to the body part by the locking part 350 and the latch part 340 movably installed in the body part 310 is bonded to the transformation inducing unit 200, the latch part 340 moves to unlock the locking part 350. When the locking part 350 is unlocked, the first body portion 320 separated from the body part 310 and displaced generates a centrifugal force such that the body part 310 and the transformation inducing unit 200 are displaced together.

The body part 310 is a semi-spherical member having an accommodation space therein so that the latch part 340, the locking part 350, the auxiliary latch part 360, and the auxiliary locking accommodation space.

In addition, part 370 are installed in the an auxiliary body portion 312 is displaceably mounted on the bottom surface of the semi-spherical shape of the body part 310 via a rotary shaft 312*a* and a spring (not illustrated), and the auxiliary body portion 312 is provided with a locking protrusion 313 therein to be engaged with the auxiliary locking part 370, thereby being fixed to the body part 310.

The first body portion 320 is a hemispherical member provided above the body part 310. A hinge 321 disposed on one side of the first body portion 320 is coupled to be rotationally displaced through a coupling hole 311 of the body part 310 and a rotary shaft 322.

In addition, the first body portion 320 is configured to be rotationally displaced using the elastic force of the spring 323. When the first body portion 320 is rotated by the elastic force of the spring, the body part 310 provided below the first body portion 320 is displaced to expose the bottom surface of the body part 310 by the centrifugal force generated by the rotation of the first body portion 320 and the elastic force of the spring 323.

The second body portion 330 is installed to be rotatably displaceable inside the first body portion 320 through a hinge 331 disposed on one side and a rotary shaft 332 such that the second body portion 330 is rotated by the elastic force of the spring 333.

The latch part 340 is provided in the body part 310 to be movable through the attractive force with the transformation inducing unit 200 by a magnetic field, and includes a latch part body 341, latch part slides 342 having an inclined surface inclined at a predetermined angle and provided on the opposite sides of the latch part body 341, a magnet 343 provided below the latch part body 341 to form a magnetic field, and a spring 344 configured to provide an elastic force such that the latch part body 341 maintains a predetermined position.

The locking part 350 is configured to support the body part 310 and the first body portion 320 such that the body part 310 and the first body portion 320 maintain the locking state, and is installed to be slidable by being engaged with the latch part 340. The locking part 350 includes a locking body part 351, a locking part slide 352 having an inclined surface inclined at a predetermined angle and provided on one side of the locking body part 351, and a locking protrusion 353 installed on the other side of the locking body part 351. The locking part slide 352 is disposed to be engaged with the latch part slide 342, so that the locking part 350 is movable in the horizontal direction in response to the vertical movement of the latch part 340.

The auxiliary latch part 360 is provided so as to be movable when the pressing force applied by the first body unit 320 is removed. The auxiliary latch part 360 includes an auxiliary latch part body 361, a protrusion 362 extending upwards from the auxiliary latch part body 361 by a predetermined length, auxiliary latch part slides 363 provided on the opposite side surfaces of the auxiliary latch part body 361 and including an inclined surface inclined at a predetermined angle, and a spring 364 configured to provide an elastic force such that the auxiliary latch part body 361 maintains a predetermined position.

The auxiliary locking part 370 is configured to maintain the locking state such that the auxiliary body portion 312 is fixed to the body part 310. The auxiliary locking part 370 includes an auxiliary locking body part 371, an auxiliary locking part slide 372 provided on one side of the auxiliary locking body part 371 to form an inclined surface to be engaged with the auxiliary latch part slide 363, and a hook 373 provided on the other side of the auxiliary locking body part 371 to be engaged with the locking protrusion 313 of the auxiliary body portion 312.

Next, an operation process of the transforming toy 300 according to the second embodiment will be described.

First, the second body portion 330 is rotated and arranged so as to be located inside the first body portion 320, and the first body portion 320 is arranged to form a spherical shape with the body part 310 to be in the locked state by the locking part 350.

At this time, an end of the second body portion 330 presses the auxiliary latch part 360 inside the first body portion 320, thereby maintaining the locked state in which the auxiliary locking part 370 and the auxiliary body portion 312 are coupled to each other.

Thereafter, when the transformable toy 300 holding the first shape, which is a spherical shape, is fired so as to roll or move towards the transformation inducing unit 200 disposed at an arbitrary position on the ground as illustrated in FIG. 12A, the transformable toy 300 comes into contact with the transformation inducing unit 200 during movement. At this time, when an attractive force is generated by a magnetic field between the latch part 340 and the transformation inducing unit 200 and thus the latch part 340 moves towards the transformation inducing unit 200 side, the locking part 350 slides by the movement of the latch part 340, so that the body part 310 and the first body portion 320 is unlocked.

When the first body portion 320 is unlocked, the first body portion 320 is separated from the body part 310 by the elastic force of the spring 323 to be rotated.

That is, as illustrated in FIG. 12B, the first body portion 320 is displaced in a direction opposite the direction in which the transformable toy 300 moves, and an inertial force is generated in the body part 310 in the rotational displacement direction of the first body portion 320 by the elastic force of the spring 323 and the centrifugal force generated through the rotational displacement of the first body portion 320.

The inertial force generated in the body part 310 partially rotates the body 310 in the direction in which the bottom surface of the body part 310 is exposed.

At this time, the transformation inducing unit 200 attached to the bottom surface of the body part 310 through the latch part 340 and the attractive force of the magnetic field also rotates with the body part 310.

When the first body portion 320 is unlocked and displaced, the second body portion 330 installed inside the first body portion 320 is rotationally displaced due to the elastic force of the spring 333, and thus the auxiliary locking part 370, which has been kept in the locked state by the auxiliary latch part 360, is unlocked from the auxiliary body portion 312.

Upon being unlocked through the displacement of the first body portion 320, the auxiliary body portion 312 is separated from the body part 310 to press against the ground as in FIG. 12C such that the bottom surface of the transformation inducing unit 200 bonded to the body portion 310 is exposed, whereby the bottom surface of the body part 310 and the bottom surface of the transformation inducing unit 200 bonded to the body part 310 are more exposed.

Accordingly, various ways to play such as playing cards can be provided by developing the spherical toy and lifting the transformation inducing unit disposed below the toy upwards.

While descriptions have been made with reference to the embodiments of the present disclosure, a person ordinarily skilled in the art can understand that the present disclosure may be variously modified and changed without departing from the technical idea and scope of the present disclosure described in the claims.

In addition, the reference numerals in the claims of the present disclosure are described for clarity and convenience of description, and the present disclosure is not limited by the reference numerals. In the course of describing the embodiments, the thicknesses of the lines and the sizes of the components shown in the drawings may be exaggerated for clarity and convenience of explanation. Since the above-described terms are defined in consideration of the functions in the present disclosure and may vary depending on the intention of a user or an operator or custom, the interpretation of these terms should be made based on the contents of this specification.

What is claimed is:

1. A transformable toy having a first shape before transformation, the transformable toy comprising:

a main body; and a transformation inducing unit, wherein the main body comprises:

a body part;

at least one first body portion displaceably connected to the body part, wherein the at least one first body portion includes at least one pressing part rotatably fixed to a portion of the at least one first body portion; and a locking part configured to fix the at least one first body portion to the body part, and wherein, when the locking part is bonded to the transformation inducing unit to be unlocked, the at least one first body portion is separated from the body part, and the at least one pressing part rotatably fixed to the portion of the at least one first body portion is rotated via the at least one first body portion to press the floor, causing the body part and the at least one first body portion to be moved in an upward direction from the floor to pop up, and when the body part and the at least one first body portion are popped up from the floor, the body part is rotated around the at least one first body portion so that the toy transforms into a second shape.

2. The transformable toy of claim 1, wherein the first shape is any one of a spherical shape, a cylindrical shape, and an elliptical shape.

3. The transformable toy of claim 1, wherein the transformation inducing unit bonded to the body part is rotated around the at least one first body portion.

4. The transformable toy of claim 3, wherein the transformation of the toy by the transformation inducing unit includes an operation in which at least a portion of the main body lifts up the transformation inducing unit.

5. The transformable toy of claim 4, wherein, in the second shape, a bottom surface of the transformation inducing unit is exposed when the transformation inducing unit is lifted up by the portion of the main body.

6. The transformable toy of claim 4, wherein the portion that lifts up the transformation inducing unit is the body part of the main body.

7. The transformable toy of claim 3, wherein the unlocking of the locking part by the transformation inducing unit is caused by a magnetic force.

8. The transformable toy of claim 7, wherein the second shape of the transformable toy form a shape of any one of an object, an animal, a human, and a character.

9. The transformable toy of claim 1, wherein, in the second shape, the entire main body except for the at least one pressing part is transformed into a state of floating from the floor.

10. The transformable toy of claim 1, wherein the transformable toy further comprises: a rotary shaft installed on the body part and coupled to the at least one first body portion at each end thereof, the rotary shaft being configured to movably support the at least one first body portion; and a rotary shaft torsion part installed on the body part and the rotary shaft, the rotary shaft torsion part being configured to provide an elastic force such that the body part rotates about the rotary shaft when the at least one first body portion is moved away from the body part.

11. The transformable toy of claim 10, wherein the body part includes an accommodation space formed therein and the locking part is installed on the body part to support the at least one first body portion such that the at least one first body portion is fixed to the body part, wherein the locking part is configured to unlock the at least one first body portion when the locking part is attached to the transformation inducing unit.

12. The transformable toy of claim 10, wherein the locking part comprises:

a locking body part;

a locking protrusion extending from an end of the locking body part by a predetermined length such that the first body portion is coupled thereto;

a magnet installed on the bottom of the locking body part; and a locking spring configured to provide an elastic force such that the locking body part maintains a fixed position.

13. The transformable toy of claim 1, wherein the first shape forms a shape of a moving object.

14. The transformable toy of claim 13, wherein the first shape forms a shape of any one of an automobile, a ship, an airplane, a building, an object, an animal, and a character.

* * * * *